US009976432B2

(12) United States Patent
Higuchi et al.

(10) Patent No.: US 9,976,432 B2
(45) Date of Patent: May 22, 2018

(54) RADIAL VANE AND METHOD OF MANUFACTURING SAME

(71) Applicant: STB HIGUCHI CO., LTD., Osaka-shi, Osaka (JP)

(72) Inventors: Izumi Higuchi, Osaka (JP); Yasushi Ueba, Osaka (JP); Hideaki Nishimura, Osaka (JP); Masaki Higuchi, Osaka (JP)

(73) Assignee: STB HIGUCHI CO., LTD., Osaka (JP)

( * ) Notice: Subject to any disclaimer, the term of this patent is extended or adjusted under 35 U.S.C. 154(b) by 819 days.

(21) Appl. No.: 14/374,427

(22) PCT Filed: Jan. 25, 2013

(86) PCT No.: PCT/JP2013/051615

§ 371 (c)(1),
(2) Date: Jul. 24, 2014

(87) PCT Pub. No.: WO2013/111865

PCT Pub. Date: Aug. 1, 2013

(65) Prior Publication Data

US 2014/0356148 A1 Dec. 4, 2014

(30) Foreign Application Priority Data

Jan. 27, 2012 (JP) ..... 2012-015843

(51) Int. Cl.
*F01D 5/30* (2006.01)
*A46B 3/06* (2006.01)
(Continued)

(52) U.S. Cl.
CPC ..... *F01D 9/045* (2013.01); *A46B 3/04* (2013.01); *A46B 13/001* (2013.01); *A46D 3/04* (2013.01); *Y10T 29/49336* (2015.01)

(58) Field of Classification Search
CPC ..... A46B 3/06; A46B 3/10; A46B 13/001; A46B 13/003; A46B 13/008; A61C 7/16; F01D 5/3061; F01D 5/34
(Continued)

(56) References Cited

U.S. PATENT DOCUMENTS 2,860,921 A * 11/1958 Clief, Jr. ..... A46D 3/05 15/181
6,471,300 B1 * 10/2002 Tomiyama ..... A46B 7/08 15/27
(Continued)

FOREIGN PATENT DOCUMENTS

JP 2003-219911 A 8/2003
JP 2004-97692 A 4/2004
(Continued)

OTHER PUBLICATIONS

International Search Report for the Application No. PCT/JP2013/051615 dated Apr. 9, 2013.

*Primary Examiner* — Sean J Younger
(74) *Attorney, Agent, or Firm* — Cheng Law Group, PLLC

(57) ABSTRACT

Provided is a radial vane with which manufacturing is possible with superior economy, without incurring a cut loss associated with vane separation in a weld part of a thread bundle. With a longitudinal intermediate part of a contiguous bundle of threads being a fold-over part, both end parts of the fold-over part of the thread bundle are opened into radial shapes and superpositioned, leaving a space in the center part of the fold-over part, a ring-shaped fold-over part (12) is formed within the circumference of the space in the center part thereof. The outer part of the ring-shaped fold-over part (12) is welded in a ring shape, forming a ring-shaped core part (13). A through hole (11) is formed in the inner side of the fold-over part (12), and radial vane parts
(Continued)

(14) are formed in which a plurality of thread materials (21) extend outward from the core part (13) toward the outer circumference side from all regions of the circumference direction. The ring-shaped fold-over part (12) is either an un-welded part or an incompletely welded part which protrudes in a dome shape in both surfaces and protrudes in an arch shape into the center, and is also efficacious as a boss part for gap adjustment when a plurality of radial vanes (10) are fixed in an axle, forming a brush head, as well as functioning simultaneously as a slide part which makes fixing easy, and as a grip part which anchors the fixed vanes.

8 Claims, 11 Drawing Sheets

(51) Int. Cl.

| | |
|---|---|
| ***A46B 3/10*** | (2006.01) |
| ***A46B 13/00*** | (2006.01) |
| ***F01D 9/04*** | (2006.01) |
| ***A46D 3/04*** | (2006.01) |
| ***A46B 3/04*** | (2006.01) |

(58) Field of Classification Search
USPC ..... 416/223 R, 229 R
See application file for complete search history.

(56) References Cited

U.S. PATENT DOCUMENTS

| | | | | |
|---|---|---|---|---|
| 7,992,246 | B2 * | 8/2011 | Takeuchi | A46B 9/026 15/167.1 |
| 2005/0076460 | A1 | 4/2005 | Tomiyama | |

FOREIGN PATENT DOCUMENTS

| | | | | |
|---|---|---|---|---|
| JP | 4000355 | B2 | 10/2007 | |
| JP | 4673802 | B2 | 4/2011 | |
| JP | 4756616 | B1 | 8/2011 | |
| WO | WO 2010099769 | A1 * | 9/2010 | A46B 13/001 |

* cited by examiner (a)

(b)

RADIAL VANE AND METHOD OF MANUFACTURING SAME

TECHNICAL FIELD

The present invention relates to a radial vane in a disk-shape which is employed in a cylindrical brush used as a brush head of a 360-degree toothbrush, a cleaning brush, and an industrial brush, and a method of manufacturing the same.

BACKGROUND ART

Conventionally, there have been proposed a 360-degree toothbrush as described in Patent Document 1, as a kind of toothbrush. The toothbrush has a cylindrical brush head in a tip portion of a brush handle. The cylindrical brush head is constructed by laminating disk-shaped radial vanes in a central axis direction. A conventional structure of a disk type radial vane is shown in FIGS. 11(*a*) and 11(*b*).

A disk-shaped radial vane 1 is constructed by a disk-shaped annular core part 2 in which a tip portion of a brush handle passes through its inner side, and a radial vane part 3 which is formed by extending a lot of thread materials 21 to an outer peripheral direction from a whole region in a peripheral direction of the annular core part 2. The annular core part 2 is a weld part to which a lot of thread materials 21 are connected, and an inner side of the annular core part 2 forms a through hole 4 for inserting the handle. In the radial vane 1 described in Patent Document 1, in order to make density of flocked fabric in a central axis direction in the brush head small, annular protrusions 5 are integrally formed in both surfaces of the annular core part 2 so as to form a so-called boss part.

As a method of manufacturing the radial vane as mentioned above, there has conventionally employed methods which are basically based on the same principle, as described in Patent Documents 1 to 3. A manufacturing principle will be described with reference to FIG. 12. A manufacturing apparatus of the radial vane manufactures the radial vane 1 from a thread bundle 20 which is formed by bundling the thread materials 21 of nylon resin. For this manufacturing, the manufacturing apparatus is provided with a horizontal processing bed 30 and a columnar welding head 40 which is provided on the bed.

The processing bed 30 is provided with a vertical through hole 31 through which the thread bundle 20 passes. The columnar welding head 40 is arranged on the through hole 31 of the processing bed 30 so as to be concentrically vertical, and is driven up and down in the central axis direction by a driving mechanism (not shown). The welding head 40 is a welding horn which carries out welding on the basis of supersonic vibration, and is oscillated and driven by a vibrator (not shown). A circular tip face of the welding head 40 is a weld surface 41.

In the manufacturing of the radial vane 1, first of all, the thread bundle 20 protrudes at a predetermined amount onto the processing bed 30 through the through hole 31 of the processing bed 30 in a state in which the welding head 40 on the processing bed 30 is in an upward evacuated position. The thread bundle 20 is pushed up by a push-up chuck which is provided below the processing bed 30 and is not shown. A protruding amount of the thread bundle 20 is set according to a radius of the radial vane 1 to be manufactured/

In the case that the thread bundle 20 protrudes at the predetermined amount onto the processing bed 30, the welding head 40 moves down while vibrating from the upward evacuated position, and the thread materials 21 forming the protruding part are uniformly expanded to the periphery by the tip portion of the welding head 40. On the basis of the further continuous downward movement of the welding head 40, the periphery of the center part of the radially opened thread materials 21 is finally pressed to the periphery of the through hole 31 on the surface of the processing bed 30, by the weld surface 41 of the welding head 40. As a result, the thread materials 21 in the protruding part of the thread bundle 20 are bent vertically to the periphery and are open radially, and the periphery of the center part of the radially opened thread materials 21 is welded by the weld surface 41 in a tip of the welding head 40. Further, the center part of the radially opened thread materials 21 is promoted to be welded by heat transmission from the periphery of the center part, and finally forms a welded and solidified part 25.

In the case that the periphery of the center part of the radially opened thread materials 21 is welded, an annular weld part 22 thereof is separated from an inside thread bundle part. As a result, the completed radial vane 1 is separated from the thread bundle 20, and the annular weld part 22 forms the disk-shaped annular core part 2 in the radial vane 1. Further, the welded and solidified part 25 formed in the tip portion of the thread bundle 20 is cut and removed in preparation for manufacturing the next radial vane 1, after separating the completed radial vane 1.

In the manufacturing method described in Patent Document 1, the boss parts (the annular protrusions 5 and 5) for making the density of flocked fabric in the central axis direction in the brush head small are integrally formed by flowing of the melting material during welding in the periphery of the center part of the radially opened thread materials 21 (during formation of the annular weld part 22). Further, in the manufacturing method described in Patent Document 3, the periphery of the center part of the radially opened thread materials 21 and the center part are formed and separated by a cylindrical separation jig doubling as a guide of the thread bundle 20 during welding of the periphery of the center part of the radially opened thread materials 21, and it is possible to achieve reduction of a manufacturing man hour and shortening of a manufacturing time.

On the other hand, in the manufacturing method described in Patent Document 2, in order to enlarge density of the thread materials in the vane parts 3 of the completed radial vane 1 and in order to enhance mechanism strength of the annular core part 2, the thread bundle 20 is protruded onto the radial vane 1 again through the through hole 4 which is formed in the inner side of the annular core part 2, while keeping the completed radial vane 1 at a fixed position on the processing bed 30, the periphery of the center part is welded annularly by again opening the thread bundle 20 to the periphery, and the inner side of the annular weld part 22 is separated. According to the structure, the radial vane 1 of double structure (two-ply structure) integrated by the annular core part 2 is manufactured.

However, in any manufacturing method, whenever the radial vane 1 is manufactured on the processing bed 30, the tip portion of the thread bundle 20 separated from the radial vane 1 forms the welded and solidified part 25, and is cut and removed since the tip portion forms an obstacle at the manufacturing time of the next radial vane 1. A length of the removed part reaches about 3 mm to be on the safe side, and a cut loss of the thread bundle 20 generated thereby increases a manufacturing cost, and forms a great obstacle against reduction of the manufacturing cost. In the case of the radial vane 1 of double structure described in Patent Document 3, two removed parts are generated every time one radial vane 1 is manufactured. Therefore, the cut loss of one thread bundle 20 comes to several mm.

An inner diameter of the through hole 4 in the radial vane 1 basically coincides with an outer diameter of the thread bundle 20. The inner diameter of the through hole 4 can be made larger, however, it is necessary to more greatly remove the annular weld part 22 (the annular core part 2), and the cut loss caused by the weld part separation in the thread bundle 20 is further increased.

Further, the annular core part 2 of the manufactured radial vane 1 is thin and hard (due to no elasticity) since the thread materials 21 are formed by the supersonic welding. Therefore, in the case that the inner diameter of the core part (the diameter of the inside through hole) is smaller than the outer diameter of the shaft part of the handle, not only work becomes hard when the radial vane 1 is fitted to the shaft part, but also the annular core part 2 is easily broken. On the contrary, in the case that the inner diameter of the through hole 4 (the handle insertion hole) formed in the inner side of the annular core part 2 is large, the radial vane 1 is not fixed to the shaft part, and idle running at the using time comes to a problem.

As a result, since strict precision is demanded in the inner diameter of the annular core part 2, and the articles having defective precision are increased, the manufacturing cost of the radial vane 1 is increased.

PRIOR ART DOCUMENTS

Patent Documents

Patent Document 1: Japanese Patent No. 4000355
Patent Document 2: Japanese Patent No. 4673802
Patent Document 3: Japanese Patent No. 4756616

SUMMARY OF THE INVENTION

Problems to be Solved by the Invention

An object of the present invention is to provide a radial vane which can freely set an inner diameter of a through hole, can make cut loss of a thread bundle as small as possible regardless of magnitude of an inner diameter, and is excellent in economical efficiency, and a method of manufacturing the same.

The other object of the present invention is to provide a radial vane which can remove the other factors for increasing the manufacturing cost as well as the cut loss, is further economically efficient and has a high-performance, and a method of manufacturing the same.

Solutions to the Problems

In order to solve the objects motioned above, the inventors of the present invention have found out a structure and a manufacturing method of a radial vane on the basis of an idea which is absolutely different from the conventional idea, and have completed the present invention.

In other words, in the manufacturing of the conventional radial vane, the protruding amount of the thread bundle is determined per the minimum unit number, for example, two radial vanes of the double structure, the thread bundle is radially opened while setting the base end side of the protruding part to a starting point, the base end part is thereafter welded, and the vane is separated from the thread bundle in the weld part. As a result, the cut loss is unavoidably generated according to the weld part separation of the thread bundle per the minimum unit number.

Consequently, the inventors of the present invention have thought of a manufacturing method of setting a longitudinal intermediate part of the thread bundle having a length of two radial vanes to a fold-over part, radially opening and superposing the thread bundle in both end sides of the fold-over part while leafing a space in a center part, and annularly welding a spatial periphery of the center part, particularly an outer side of a annular fold-over part formed in the spatial periphery of the center part, by paying attention to the fact that the double structure (the two-ply structure) is proper for the density of the thread material of the vane part in the radial vane. According to the manufacturing method, a lot of two-folded thread materials are lined up radially in the spatial periphery of the center part. More specifically, a lot of thread materials stereoscopically superposed in the inner peripheral part are dispersed in the peripheral direction toward the outer peripheral side so as to be formed planar. Further, a lot of thread materials stereoscopically superposed in the inner peripheral part are integrated by being annularly welded, and form a radial vane of double structure (two-ply structure).

According to the fold-over manufacturing method, since any vane separation step does not exist in the thread bundle weld part, the radial vane of the double structure (the two-ply structure) having the great density of the thread materials can be manufactured from one continuous thread bundle without generation of cut loss caused by separation of weld part of the thread bundle. In other words, it is not necessary to carry out a work for separating the formed radial vane from the thread bundle by forming the longitudinal intermediate part of the thread bundle having the length corresponding to two radial vanes as the annular fold-over part, and welding the inner peripheral parts, and any cut loss caused by the separation of the weld part in the thread bundle is not generated at all. Further, a magnitude of the space of the center part can be optionally set, and the magnitude thereof does not affect the cut loss.

The annular weld part in the spatial periphery of the center part is initially welded completely to the inner peripheral edge of the fold-over part. As a result, the annular weld part comes into contact with space of the center part. However, the following fact has been found in the thereafter process of making a study of the weld position. More specifically, in the case that the outer peripheral side of the annular fold-over part is particularly welded annularly, and the annular fold-over part is left in the spatial periphery of the center part, the annular fold-over part forms a boss part having an arch shaped cross section which is convex to the center side, being thick and having an elasticity, and serves as both a slide part and a grip part which are excellent functionally.

More specifically, since the annular fold-over part left in the inner side of the annular weld part is a non-weld part or an incomplete weld part, and the thread materials forming the thread bundle are formed by being curved to be round on the basis of the elasticity, the annular fold-over part becomes thicker than the outside annular weld part, and has the greater elasticity than the annular weld part. Further, the thread materials are directed to the central axis direction in the inner peripheral surface of the annular fold-over part. For these reasons, the annular fold-over part not only serve a spacer function in the brush head as an effective boss part, but also can make the radial vane be tightly fitted to the shaft without generation of any breakage. As a result, tolerance for inner diameter error of the through hole in the inner side of the fold-over part is increased.

Accordingly, on the basis of the arch shaped boss part which is thick and is left its elasticity, when the completed radial vane is compressed to the shaft, the radial vane can be smoothly compressed even if the radial vane is somewhat tight. Risk that the annular weld part is broken is extremely small at that time. Further, the radial vane which is once compressed and fitted is hard to come off from the shaft and is hard to rotate in the peripheral direction.

As mentioned above, according to the fold-over manufacturing method created by the inventors of the present invention, it is possible to effectively remove a factor raising the manufacturing cost while making the density of the thread materials in the vane parts of the radial vane reasonable, and making the density of flocked fabric in the central axis direction in the brush head reasonable. Further, it is possible to manufacture the radial vanes having various sizes and shapes by selecting a length of the thread bundle and a position of the fold-over part, and further selecting an inner diameter of the space of the center part.

The radial vane according to the present invention is made on the basis of the knowledge, and is structurally characterized by a radial vane in a disk-shape including: radial vane parts which are formed by extending a lot of thread materials to an outer peripheral side from a whole region in a peripheral direction of a disk-shaped annular core part having a through hole in a center part, wherein a longitudinal intermediate part of one continuous thread bundle is formed as a fold-over part, thread bundles in both end sides of the fold-over part are radially opened and superposed while leaving a space in a center part, and a spatial periphery of the center part is annularly welded so as to form the core part. The radial vane is particularly preferably structured such that an outer side of an annular fold-over part formed in a spatial periphery of the center part is annularly welded so as to form the core part.

In the radial vane according to the present invention, the space of the center part forms a through hole, and the radial vane parts are formed in the periphery of the through hole via the annular core part. Preferably, an annular fold-over part having an arch shaped cross section is formed in the periphery of the through hole and the radial vane parts are formed in further outer side thereof via the annular core part.

Here, since the annular fold-over part is welded its outer side, the annular fold-over part is a non-weld part or an incomplete weld part. Further, the thread materials forming the thread bundle are not completely bent, but are curved like an arch on the basis of the elasticity of the thread materials. According to the structures, the annular fold-over part forms a thick boss part. Further, since the greater elasticity than the annular core part corresponding to the weld part is left, the annular fold-over part also forms a grip part which fixes the vane when the radial vane is fitted to the shaft. Further, due to a direction of the thread materials in the inner surface of the annular fold-over part, the annular fold-over part also forms an effective slide part. Further, the annular fold-over part also forms an effective reinforcing part for the inner annular core part. In other words, since the welding is carried out from both surface sides when the annular core part is welded, and the pressure is easily concentrated, material melting is promoted, and a mechanical strength of the annular core part itself is great.

As can be known from the structure, the most important structure in the radial vane according to the present invention exists in a point that the vane is formed in both sides by folding over in the intermediate part of the thread bundle, and the annular fold-over part is formed in the periphery of the through hole of the vane center part accordingly, and particularly exists in a point that the thick annular fold-over part constructed by the non-weld part or the incomplete weld part is formed so as to face to the through hole. The thickness and the hardness of the annular fold-over part can be adjusted by changing the welding position, and in correspondence to the thickness and the number of the thread materials.

Further, a method of manufacturing a radial vane according to the present invention is a method of manufacturing a radial vane in a disk-shape including: radial vane parts which are formed by extending a lot of thread materials to an outer peripheral side from a whole region in a peripheral direction of a disk-shaped annular core part having a through hole in a center part, the method including:

a first opening step of setting a longitudinal intermediate part of one continuous thread bundle to a fold-over part, and radially opening a thread bundle in one end side of the fold-over part to the periphery in a state in which the fold-over part is set to a starting point and a space is secured in the center part;

a first welding step of annularly welding the thread bundle in the one end side radially opened to the periphery in a spatial periphery of the center part;

a second opening step of radially opening a thread bundle in the other end side of the fold-over part to the periphery in a state in which the fold-over part is set to a starting point and a space is secured in the center part; and a second welding step of annularly welding the thread in the other end side radially opened to the periphery in the spatial periphery of the center part.

Accordingly, it is possible to effectively manufacture the radial vane without any vane separation in the weld part.

Particularly, in the case that the thread bundles in both end sides opening radially to the periphery are welded annularly in the outer side of the annular fold-over part formed in the spatial periphery of the center part, in the first welding step and the second welding step, the annular fold-over part is left in the periphery of the through hole, the annular fold-over part being thick, having elasticity and doubling as the boss part, the slide part and the grip part, and the high-performance radial vane mentioned above can be manufactured without any step of separating the vane in the weld part of the thread bundle.

In the method of manufacturing the radial vane according to the present invention, the respective steps are normally executed step by step in the order of the first opening step, the first welding step, the second opening step and the second welding step, however, the first opening step and the second opening step may be simultaneously executed, and the first welding step and the second welding step may be simultaneously executed. In other words, one thread bundle may be processed step by step in both end sides of the fold-over part, and may be simultaneously processed symmetrically.

In order to secure the space in the center part of the thread bundle in the first opening step, the rod-like object is preferably inserted previously to the center part. Further, it is rational to use the welding horn used in the first welding step for opening the thread bundle. In the case that the welding horn is used for opening the thread bundle, the rod-like object is preferably protruded from the tip face of the welding horn. According to this structure, it is possible to continuously carry out the first opening step and the first welding step. In the case that the rod-like object is attached to the welding horn, the rod-like object is preferably set to a separate object which is independent from the welding horn for preventing the rod-like object from sympathetically vibrating with the welding horn. If the rod-like object sympathetically vibrates with the welding horn, the fold-over part is welded from an inner side, and it is hard to leave the annular fold-over part which is thick, has the elasticity and doubles as the boss part, the slide part and the grip part in the periphery of the through hole of the radial vane.

In the case that the steps are carried out step by step in the order of the first opening step, the first welding step, the second opening step and the second welding step, it is necessary to maintain a space which is secured in the center part in the first opening step, even in the second opening step and the second welding step which follow the first welding step, in addition to the first welding step, and it is rational to use the rod-like object for this purpose. In the case that the rod-like object is attached to the welding horn which is used in the second welding step, the rod-like object is preferably set to a separate object which is independent from the welding horn.

In the case that the rod-like object is protruded out of the tip face of the welding horn which is used in the first welding step, the rod-like object can be utilized in the second opening step and the second welding step, for maintaining the space which is secured in the center part in the first opening step. Since both the horns are moved close to each other in this case, it is necessary to form a clearance part to which the rod-like object is inserted, in the tip face of the welding horn which is used in the second welding step.

The clearance part is effective in the case that the first opening step and the second opening step are simultaneously executed, and the first welding step and the second welding step are simultaneously executed. Because both the horns are moved close to each other in this case.

In order to leave the annular fold-over part which is thick, has the elasticity and doubles as the boss part, the slide part and the grip part in the periphery of the through hole of the radial vane, it is simple and preferable for the manufacturing method and the apparatus structure, to form the clearance part in the portion (the periphery of the center part) corresponding to the annular fold-over part in the tip face of the welding horn which is used in the first welding step and the second welding step.

Effects of the Invention

The radial vane according to the present invention is structured such that the thread materials are radially folded over and welded in the periphery of the through hole of the center part, the density of the thread materials in the vane parts can be set to be identical to the radial vane of the two-ply structure, and can be manufactured without generation of any cut loss caused by the vane separation in the weld part of the thread bundle. As a result, it is possible to reduce the manufacturing cost. Further, it is possible to optionally set the magnitude of the through hole, and the setting does not affect the cut loss, and further the manufacturing cost.

Particularly, in the case of the structure in which the thick arch-shaped annular fold-over part constructed by the non-weld part or the incomplete weld part is left in the periphery of the through hole of the center part so as to face to the through hole, it is firstly possible to manufacture without generation of any cut loss caused by the weld part separation of the thread bundle, and it is possible to reduce the manufacturing cost. Secondly, the density of the thread materials in the vane parts can be made identical to the radial vane of the two-ply structure. Thirdly, it is possible to simply form the thick boss part, and it is possible to adjust the density of flocked fabric in the axial direction in a wide range in the case that the brush head is formed by superposing in the central axis direction. Fourthly, the radial vane can be tightly fixed to the shaft to be fitted, and it is possible to prevent the radial vane from idle running. Fifthly, since it is possible to increase the tolerance for inner diameter precision of the through hole, and it is possible to contribute to the reinforcement of the inside annular core part, it is possible to lower frequency of generating a defective article, and it is possible to reduce the manufacturing cost in this regard.

Further, the method of manufacturing the radial vane according to the present invention can efficiently manufacture the radial vane without any vane separation in the weld part of the thread bundle.

EMBODIMENTS OF THE INVENTION

A description will be given below of embodiments according to the present invention with reference to the accompanying drawings.

A radial vane according to the present embodiment is used in a cylindrical brush head which is installed to a handle tip portion of a 360-degree toothbrush. More specifically, the brush head in the 360-degree toothbrush is constructed by superposing a desired number of disk-shaped radial vanes in a central axis direction, each of the disk-shaped radial vanes being formed by processing thread materials of nylon resin which is used in the toothbrush, however, the radial vane according to the present embodiment is used in the disk-shaped radial vane which constructs the brush head.

Figure 1:
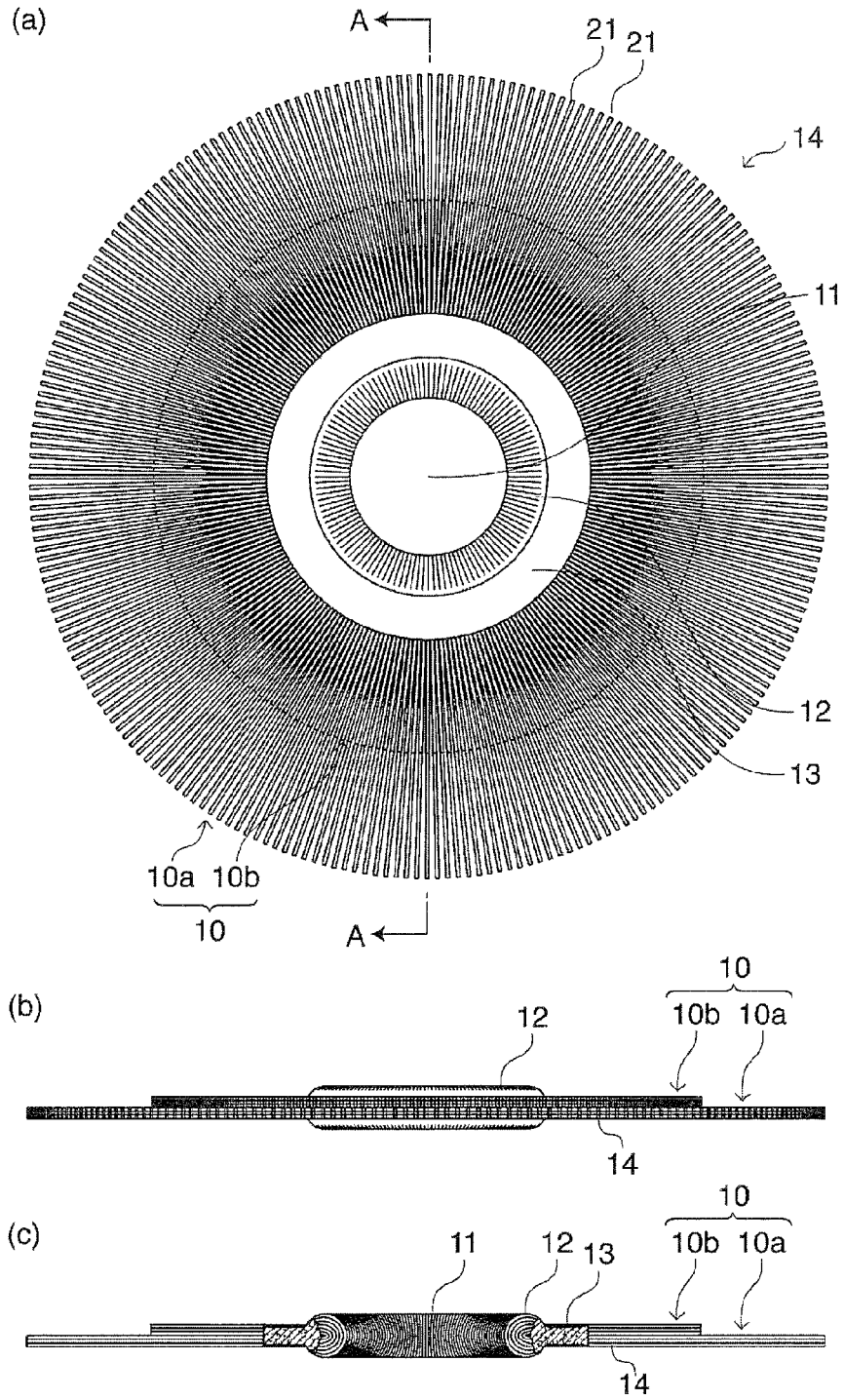
FIG. 1(*a*) is a plan view showing a structure of an example of a radial vane according to the present invention, FIG. 1(*b*) is an elevational view showing the structure of the example of the radial vane, and FIG. 1(*c*) is a vertical cross sectional view showing the structure of the example of the radial vane and corresponds to across sectional view as seen from an arrow A-A in FIG. 1(*a*).

A radial vane 10 shown in FIGS. 1(*a*) to 1(*c*) is a double structure vane obtained by integrating and superposing two radial vanes 10*a* and 10*b* in a weld part, and is formed from a bundle of a lot of thread materials (thread bundle). A center part of the radial vane 10 is provided with a circular through hole 11 to which a tip shaft part of a brush handle passes. An annular fold-over part 12 protruding like a dome to both surface side and protruding like an arch to an inner surface side is formed in the periphery of the through hole 11 so as to be in contact with the through hole 11, and an annular core part 13 is provided further in an outer side of the annular fold-over part 12, the annular core part 13 being formed by welding thread materials 21, being constructed by a thin annular plate body and having a high intensity. A lot of thread materials 21 radially extend out of the annular core part 13 with uniform density in a peripheral direction so as to form annular vane parts 14. The thread materials 21 constructing the vane parts 14 include one radial vanes 10*a* having long bristles and the other radial vanes 10*b* having short bristles in a mixed manner, the one radial vanes 10*a* and the other radial vanes 10*b* being the same number.

The number of the thread materials 21 in the radial vane 10 is identical in the peripheral direction. As a result, the thread materials 21 are stereoscopically closed up particularly in the annular fold-over part 12 which is inside the annular core part 13, and are planar in the vane parts 14 which are outside the annular core part 13, thereby being dispersed in the peripheral direction toward an outer peripheral side.

Figure 4:
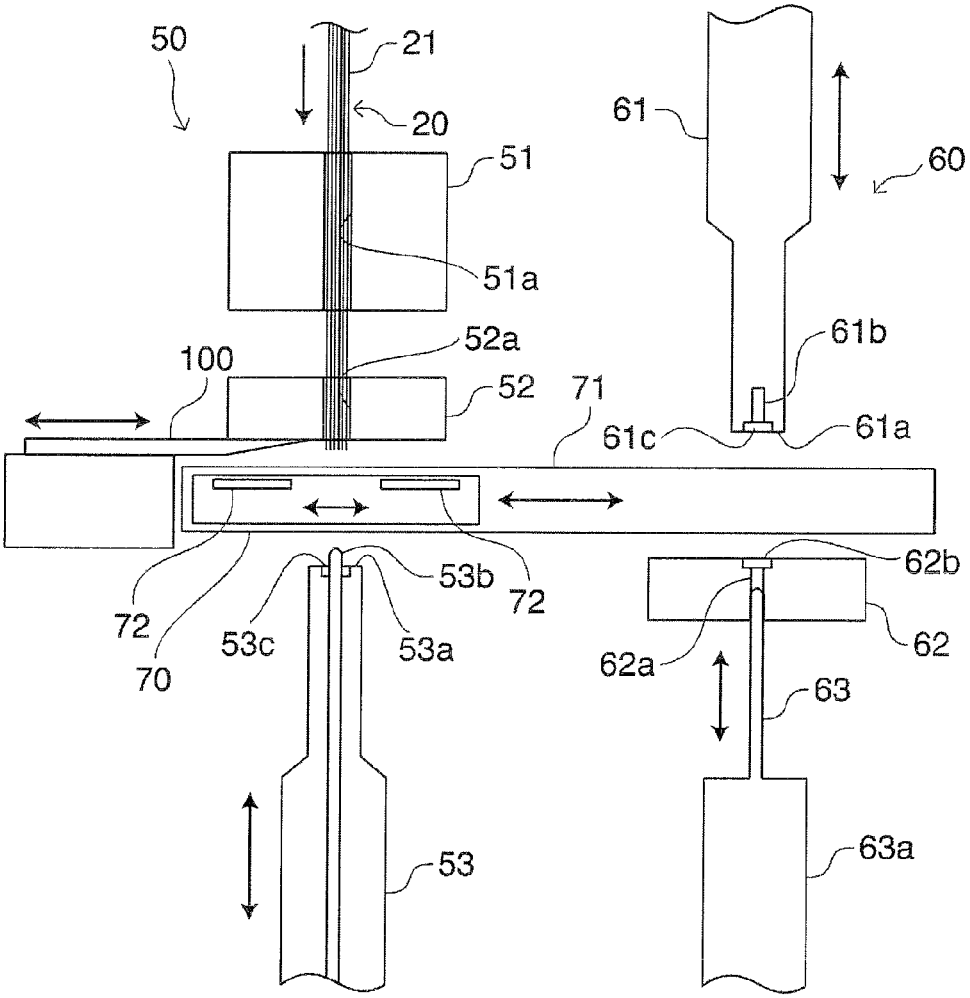
FIG. 4 shows an example of a method of manufacturing a radial vane according to the present invention, and is a structural view of a manufacturing apparatus which is suitable for manufacturing the radial vane.

A manufacturing apparatus shown in FIG. 4 is structured such as to manufacture the radial vane 10, and is provided with a first welding unit 50 and a second welding unit 60 which are arranged side by side, a clamper unit 70 which is in common used in both the welding unit, and a clamper conveyance unit 71 which is installed between both the welding units for horizontally moving. The clamper unit 70 has a separately switching type clamper 72, and restricts and releases the thread bundle 20 corresponding to a manufacturing raw material of a radial vane by combining and separating. The clamper conveyance unit 71 conveys the material from the first welding unit 50 to the second welding unit 60 on the basis of the horizontal movement of the clamper unit 70.

The first welding unit 50 forms a first radial vane 10*a* in the radial vane 10 of the double structure. The first welding unit 50 has a thread feeding unit 51, a first processing pedestal 52 and a first welding horn 53 which are concentrically arranged up and down in relation to the clamper conveyance unit 71. The thread feeding unit 51 arranged above the clamper conveyance unit 71 discharges downward the thread bundle 20 formed by bundling the thread materials 21 of nylon resin in increments of a predetermined amount. The first processing pedestal 52 arranged between the thread feeding unit 51 and the clamper conveyance unit 71 has a through hole 52*a* which passes through the thread bundle 20 discharged downward by the thread feeding unit 51 from the top to the bottom. The first welding horn 53 arranged below the clamper conveyance unit 71 is an upward supersonic transducer which is formed into a columnar shape, and is driven up and down by a driving apparatus (not shown).

A circular upper end surface of the first welding horn 53 is a weld surface 53*a*. More specifically, an annular part except a rod-like convex part 53*b* in a center part and an annular recessed part 53*c* in an outer side of the rod-like convex part 53*b* forms the weld surface 53*a*. In other words, the narrow round rod-like convex part 53*b* is provided on the circular upper end surface of the first welding horn 53 so as to be positioned at the center part, and the annular recessed part 53*c* is provided so as to surround the rod-like convex part 53*b*. The annular upper end surface in the outer side of the annular recessed part 53*c* forms the weld surface 53*a*.

The rod-like convex part 53*b* is provided for forming the through hole 11 of the radial vane 10, has an outer diameter which is sufficiently smaller than a thickness of the thread bundle 20 (an inner diameter of the through hole 52*a* in the first processing pedestal 52), and forms a circular space in the center part of the radially opened thread bundle 20. Further, the rod-like convex part 53*b* is constructed by a tip protruding part of the round rod-like separate member which is provided in the center part of the first welding horn 53 and passes through the through hole, for preventing resonance with the first welding horn 53. The annular recessed part 53*c* is a clearance part for forming the annular fold-over part 12 of the radial vane 10, particularly for forming the annular fold-over part 12 in the side of the first radial vane 10*a*.

The second welding unit 60 forms a second radial vane 10*b* in the radial vane 10 of the double structure. The second welding unit 60 has a second welding horn 61, a second processing pedestal 62 and a vertical guide pin 63 which are concentrically arranged up and down in relation to the clamper conveyance unit 71, the guide pin 63 being used for opening the thread bundle. The second welding horn 61 arranged above the clamper conveyance unit 71 is a downward supersonic transducer which is formed into a columnar shape, and is driven up and down by a driving apparatus (not shown).

A circular lower end surface of the second welding horn 61 is a weld surface 61*a*. More specifically, an annular lower end surface except an elongated circular recessed part 61*b* in a center part and a shallow annular recessed part 61*c* in an outer side of the elongated circular recessed part 61*b* forms the weld surface 61*a*. The circular recessed part 61*b* is a clearance hole which receives a guide pin 63 which moves up, and corresponds to a guide hole. The annular recessed part 61*c* is a clearance part for forming the annular fold-over part 12 of the radial vane 10, particularly forming the annular fold-over part 12 in the side of the second radial vane 10*b*.

The second processing pedestal 62 arranged below the clamper conveyance unit 71 has a through hole 62*a* to which the guide pin 63 is inserted. An annular recessed part 62*b* is provided on an upper surface corresponding to a processing surface of the second processing pedestal 62 so as to surround the through hole 62*a*. The annular recessed part 62*b* is a clearance part which accommodates the annular fold-over part 12 of the radial vane 10, particularly the annular fold-over part 12 formed in the side of the first radial vane 10*b*. The guide pin 63 is driven up and down in a vertical direction by a driving apparatus 63*a*, is upward inserted to the center part of the thread bundle 20 in a forming process of the second radial vane 10*b* by being driven to an upper side than the upper surface of the second processing pedestal 62, secures a space in the vane center part, and guides the downward moving second welding horn 61.

Next, a description will be given of a method of manufacturing the radial vane 10 shown in FIG. 1 by the manufacturing apparatus shown in FIG. 4, with reference to FIGS. 5(*a*) to 5(*g*) and FIGS. 6(*a*) to 6(*e*).

Figure 5:
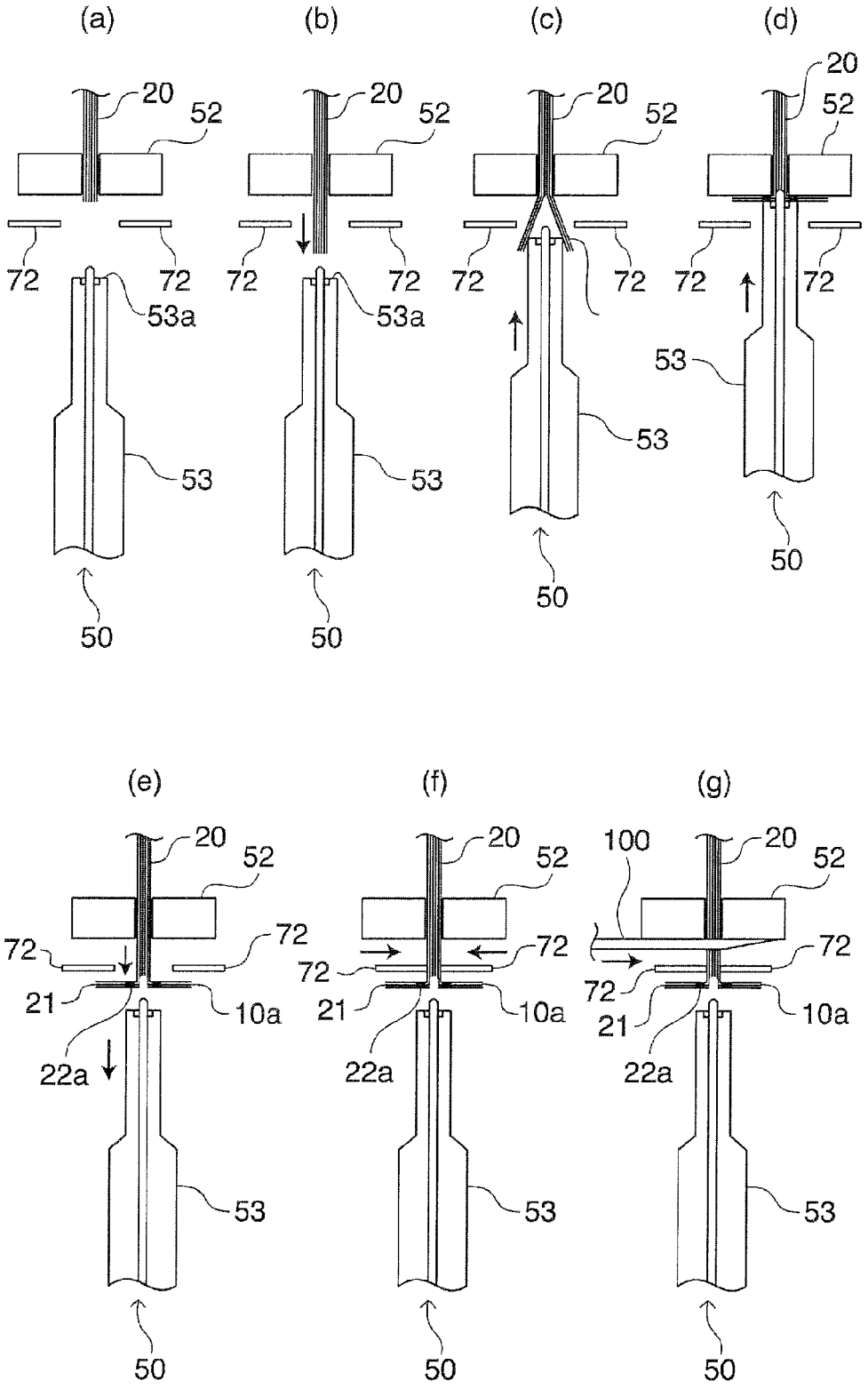
FIGS. 5(*a*) to 5(*g*) are views explaining a first step of the manufacturing method using the manufacturing apparatus.

In the manufacturing of the radial vane 10, first of all, the thread bundle 20 is discharged to the below of the first processing pedestal 52 through the through hole 52*a* of the first processing pedestal 52 by the thread feeding unit 51, as shown in FIGS. 5(*a*) and 5(*b*). A length of the thread bundle 20 discharged to the below of the first processing pedestal 52 is an amount which is necessary for manufacturing the first radial vane 10*a*.

When the discharge of the thread bundle 20 is finished, the first welding horn 53 starts moving upward from the downward evacuated position while supersonic vibrating and opens the thread materials 21 of the thread bundle 20 discharged to the below of the first processing pedestal 52 to the periphery, as shown in FIG. 5(*c*). Further, when the first welding horn 53 goes on moving upward, the thread materials 21 further open to the periphery, and the thread materials 21 opening to the periphery are finally pressed to the periphery of the through hole 52*a* in the lower surface of the first processing pedestal 52 by the annular weld surface 53*a* of the first welding horn 53, as shown in FIG. 5(*d*).

The thread materials 21 in the discharge part of the thread bundle 20 is completely opened to the periphery and formed into a radial shape, by the pressing by the weld surface 53*a* of the first welding horn 53. At the same time, since the first welding horn 53 supersonic vibrates, an annular weld part 22*a* is formed by welding the vicinity of the center part of the radial thread materials 21 which are pressed by the weld surface 53*a* of the first welding horn 53, that is, an annular part which is sandwiched between the annular weld surface 53*a* of the first welding head 53 and the surface of the first processing pedestal 52 in the periphery of the through hole 52*a*.

At this time, the rod-like convex part 53*b* provided in the center part of the upper end surface of the first welding horn 53 is inserted to the center part of the thread bundle 20 in the final stage of the opening process of the thread bundle 20 and before the welding starts, and is welded in a state in which a circular space is secured in the center part of the thread bundle 20. Since the rod-like convex part 53*b* is formed as the separate member which is independent from the first welding horn 53 so as to be inhibited resonance with the first welding horn 53, the rod-like convex part 53*b* prevents the welding of the part which is in contact with the space of the thread materials 21 radially opening to the periphery. Further, the annular recessed part 53*c* inhibits the inner edge part of the thread materials 21 radially opening to the periphery (the vicinity of the space) from being welded, and contributes to the formation of the annular fold-over part 12. As mentioned above, the formation of the first radial vane 10*a* is finished.

When the welding by the first welding head 53 is finished, and the formation of the first radial vane 10*a* is finished, the first welding horn 53 moves downward, and the thread bundle 20 is again discharged to the below of the first processing pedestal 52 by the thread feeding unit 51, as show in FIG. 5(*e*). The length of the thread bundle 20 discharged to the below of the first processing pedestal 52 is an amount which is necessary for manufacturing the second radial vane 10*b*.

When the discharging of the thread bundle 20 is finished, the clamper 72 in the separated state at the both side evacuated positions again moves to the combined position, and restricts the thread bundle 20 discharged to the below of the first processing pedestal 52, as shown in FIG. 5(*f*). In this state, the thread bundle 20 is cut along a lower surface of the first processing pedestal 52 by a cutter unit 100, as shown in FIG. 5(*g*).

When the cutting of the thread bundle 20 is finished, the clamper unit 70 moves from the first welding unit 50 to the second welding unit 60 while the clamper 72 restricts the thread bundle 20. According to this structure, the first radial vane 10*a* is conveyed to the second welding unit 60 from the first welding unit 50 together with the thread bundle 20 for forming the second radial vane 10*b*.

Figure 6:
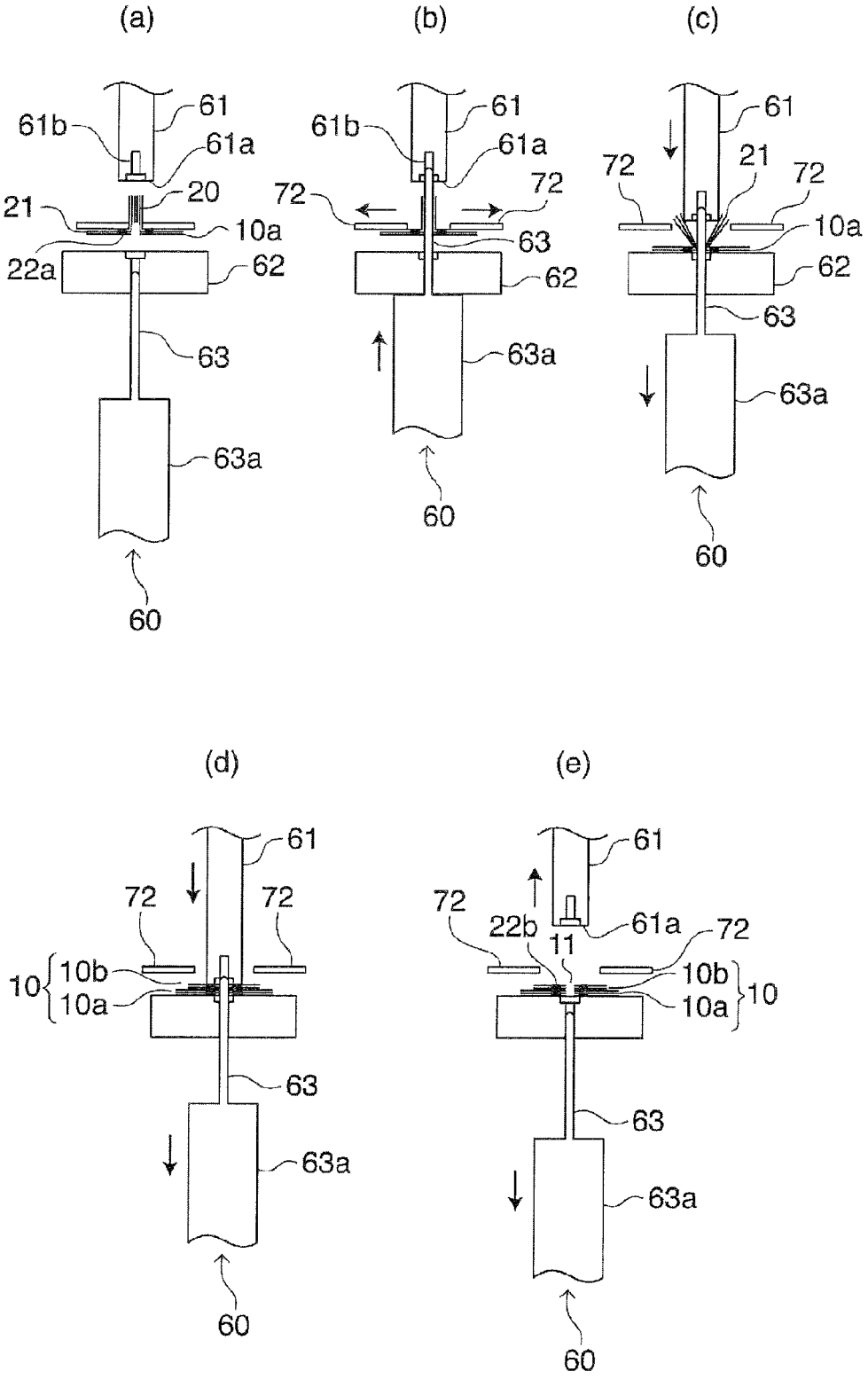
FIGS. 6(*a*) to 6(*e*) are views explaining a second step of the manufacturing method.

In the second welding unit 60, the first radial vane 10*a* and the thread bundle 20 extending upward from the center part of the first radial vane 10*a* are fixed between the second welding horn 61 and the second processing pedestal 62, as shown in FIG. 6(*a*). As a result, as shown in FIG. 6(*b*), the guide pin 63 starts moving up, passes to the through hole 62*a* of the second processing pedestal 62, passes to a circular space which is formed in the center part of the first radial vane 10*a* further above the through hole 62*a* so as to be inserted to the center part of the thread bundle 20 above the circular space, further passes through the center part of the thread bundle 20, and is inserted to the circular recessed part 61*b* which is provided in the center part of the lower end surface of the second welding horn 61.

Then, as shown in FIG. 6(*c*), the clamper 72 opens to both sides, and releases the thread bundle 20, and the second welding horn 61 starts moving down from the upward evacuated position. At the same time, the guide pin 63 starts moving down. As a result, the first radial vane 10*a* comes into contact with the upper surface of the second processing pedestal 62, and the thread materials 21 existing in the periphery of the guide pin 63 open to the periphery by being pressed downward by the weld surface 61*a* of the second welding horn 61 in this state.

In the case that the second welding horn 61 and the guide pin 63 further go on moving down, the thread materials 21 completely open to the periphery and are formed into a radial shape on the upper surface of the second processing pedestal 62, as shown in FIG. 6(*d*). At the same time, the vicinity of the center part of the radial thread materials 21 is pinched in relation to the upper surface of the second processing pedestal 62 in the periphery of the through hole 62*a* so as to be welded by the annular weld surface 61*a* of the second welding horn 61 which supersonic vibrates, and the annular weld part 22*b* (refer to FIG. 6(*d*)) is formed in the second radial vane 10*b*.

At this time, the annular recessed part 61*c* formed in the periphery of the circular recessed part 61*b* of the second welding horn 61 inhibits the inner edge part (the vicinity of the space) of the thread materials 21 opening to the periphery from being welded, and contributes to the formation of the annular fold-over part 12 in the second side. Further, the annular recessed part 62*b* formed in the periphery of the through hole 62*a* of the second processing pedestal 62 inhibits deformation of the annular fold-over part 12 which is formed in the first side by the first welding unit 50. Further, since the guide pin 63 inserted to the circular recessed part 61*b* of the second welding horn 61 is the rod-like member which is independent from the second welding horn 61, there is no resonance with the second welding horn 61, and there is no risk that the inner surface of the annular fold-over part 12 is welded.

As a result, the radial vane 10 of two-ply structure integrated by the annular weld parts 22*a* and 22*b* is formed on the second processing pedestal 62. The integrated annular weld parts 22*a* and 22*b* form the annular core part 13 of the completed radial vane 10.

In the case that the radial vane 10 is formed on the second processing pedestal 62, the second welding horn 61 returns to the upward evacuated position, and the guide pin 63 returns to the downward evacuated position, as shown in FIG. 6(*e*), thereby releasing the radial vane 10 from the restricted state.

Figure 7:
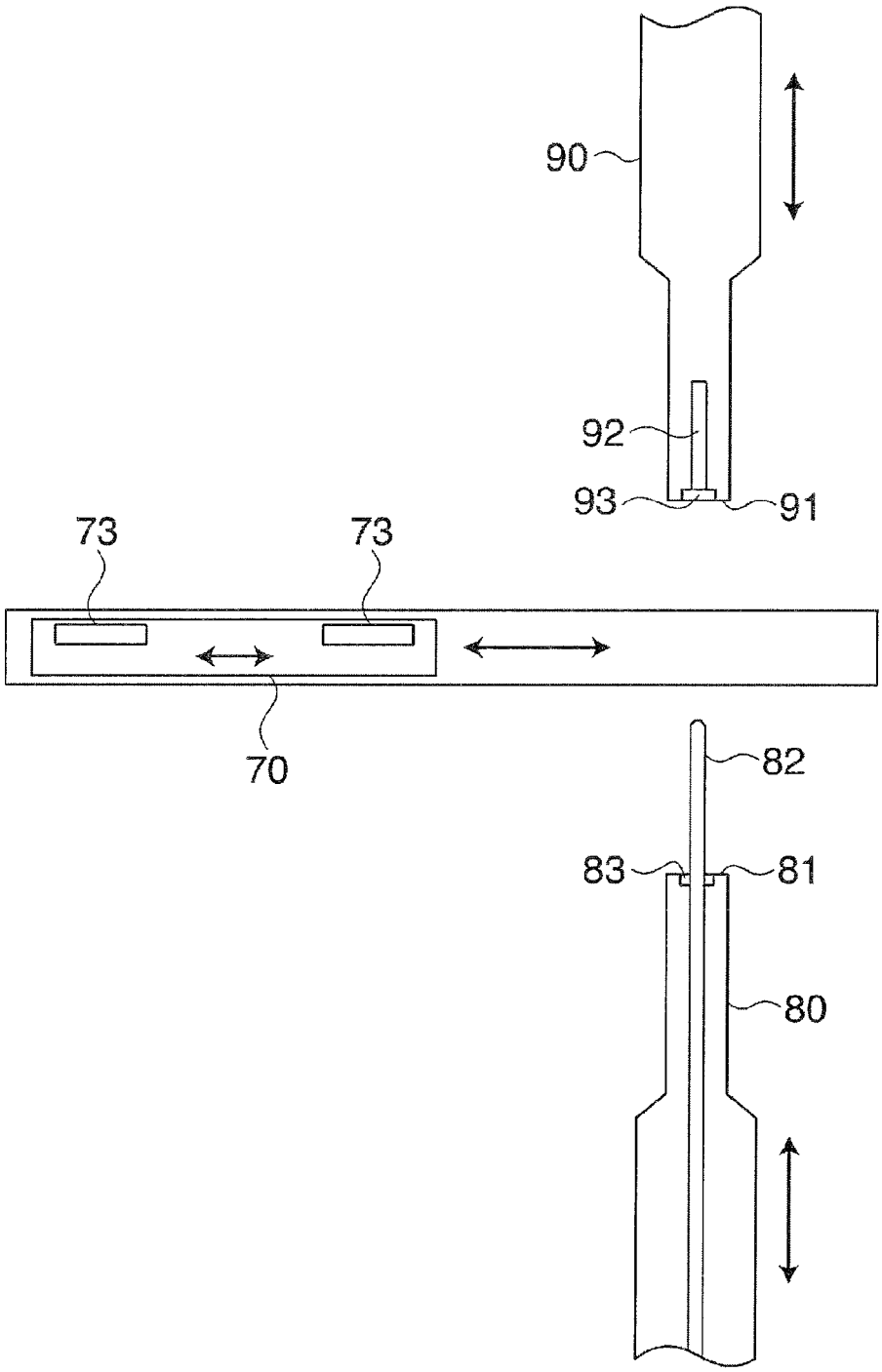
FIG. 7 shows the other example of the method of manufacturing the radial vane according to the present invention, and is a structural view of a manufacturing apparatus which is suitable for manufacturing the radial vane.

A manufacturing apparatus shown in FIG. 7 is the other apparatus for manufacturing the radial vane 10, and has a first welding horn 80 and a second welding horn 90 which are concentrically arranged up and down in relation to a clamper conveyance unit 71. The feature of the manufacturing apparatus exists in formation of the first radial vane 10*a* in the radial vane 10 of double structure and formation of the second radial vane 10*b* at the same position. The first welding horn 80 forms the first radial vane 10*a* in the radial vane 10 of double structure, and the second welding horn 90 forms the second radial vane 10*b*.

A clamper unit 70 has a split type clamper 73, and restricts and releases the thread bundle 20 which is a manufacturing raw material of the radial vane by separating and combining the split type clamper 73. The clamper 73 doubles as a processing pedestal and is manufactured with high intensity for this purpose. The clamper conveyance unit 71 conveys the material from a material receiving position in a left side of the drawing to a processing position between the first welding horn 80 and the second welding horn 90.

The first welding horn 80 arranged below the clamper conveyance unit 71 is an upward supersonic transducer which is formed into a columnar shape, and is driven up and down by a driving apparatus (not show). A circular upper end surface of the first welding horn 80 is a weld surface 81. More specifically, an annular part except a rod-like convex part 82 in an annular recessed part 83 in an outer side of the rod-like convex part 82 forms the weld surface 81.

The rod-like convex part 82 is provided for forming the through hole 11 of the radial vane 10, has an outer diameter which is smaller than a thickness of the thread bundle 20, is inserted into the center part of the thread bundle 20 in a forming process of the second radial vane 10*b* so as to form a circular space in the center part of the thread bundle 20, and guides the downward moving second welding horn 61. Further, the rod-like convex part 82 is constructed by a tip protruding part of the round rod-like separate member which is provided in the center part of the first welding horn 80 and passes through the through hole, for preventing resonance with the first welding horn 80, in the same manner as the first welding horn 50 of the manufacturing apparatus shown in FIG. 4. The annular recessed part 83 is a clearance part for forming the annular fold-over part 12 of the radial vane 10, particularly for forming the annular fold-over part 12 in the side of the first radial vane, in the same manner as the first welding horn 50.

The second welding horn 90 arranged above the clamper conveyance unit 71 is a downward supersonic transducer which is formed into a columnar shape, and is driven up and down by a driving apparatus (not shown). A circular lower end surface of the second welding horn 90 is a weld surface 91. More specifically, an annular part except an elongated circular recessed part 92 in a center part and a shallow annular recessed part 93 in an outer side of the elongated circular recessed part 92 forms the weld surface 91. The circular recessed part 61*b* is a clearance hole which receives a rod-like convex part 82 which moves up. The annular recessed part 61*c* is a clearance part for forming the annular fold-over part 12 of the radial vane 10, particularly forming the annular fold-over part 12 in the side of the second radial vane 10.

Next, a description will be given of a method of manufacturing the radial vane 10 shown in FIG. 1 by the manufacturing apparatus shown in FIG. 7, with reference to FIGS. 8(*a*) to 8(*g*).

In the manufacturing of the radial vane 10, first of all, the clamper unit 70 is positioned in a left part of the clamper conveyance unit 71, and the clamper 73 within the clamper unit 70 restricts the thread bundle 20 discharged out of a thread feeding unit which is arranged above the clamper unit 70 and is not shown. Next, the thread bundle 20 is cut by a cutter unit which is provided below the thread feeding unit and is not shown. A cut length (a discharge length) of the thread bundle 20 is an amount which is necessary for manufacturing the radial vane 10 of double structure. More specifically, a length of the thread bundle protruding downward from the lower surface (the processing surface) of the clamper 73 doubling as the processing pedestal is an amount which is necessary for the first radial vane 10*a*, and a length of the thread bundle above the lower surface (the processing surface) of the clamper 73 is an amount which is necessary for the second radial vane 10*b*.

Figure 8:
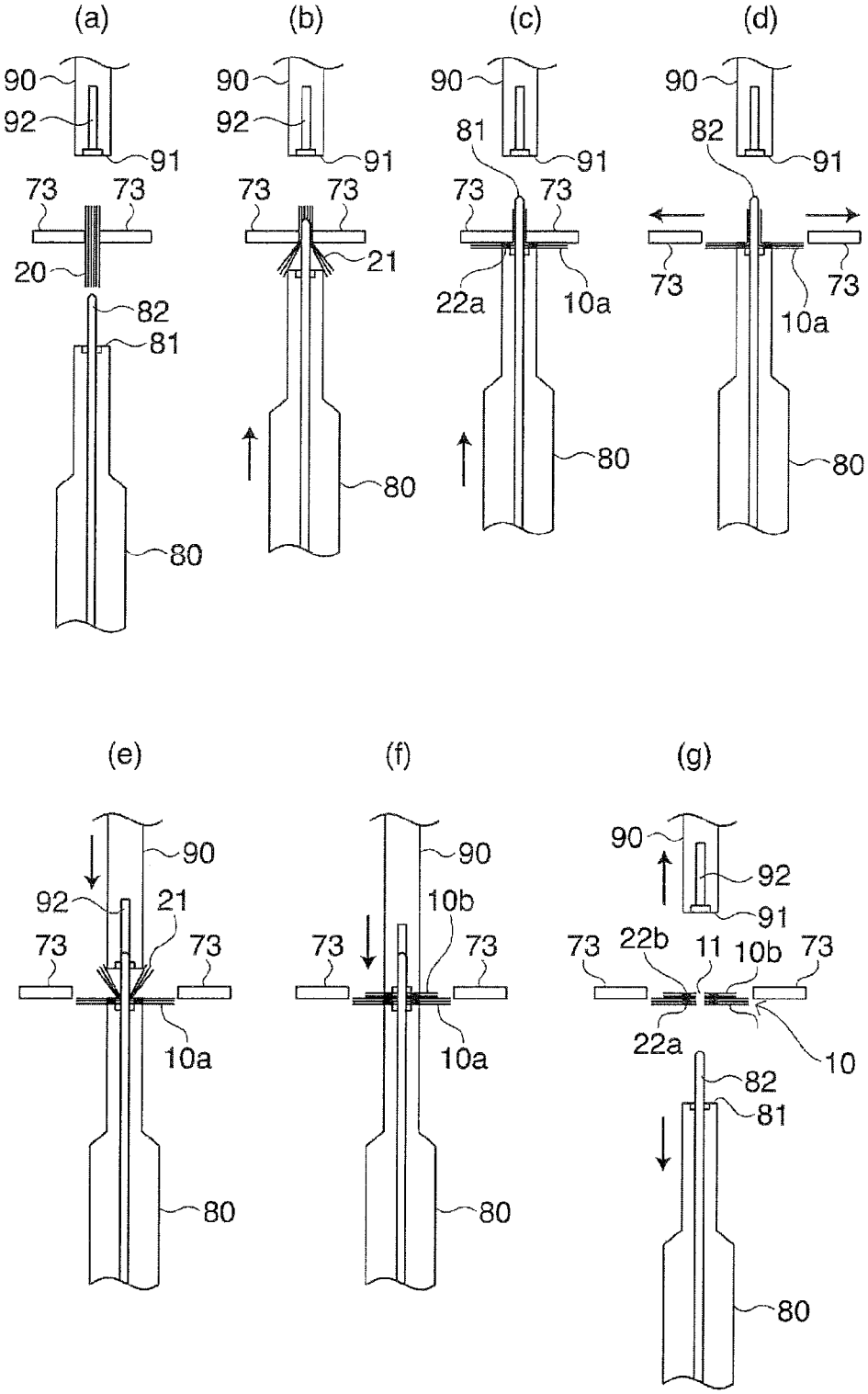
FIGS. 8(*a*) to 8(*g*) are views explaining steps of the manufacturing method using the manufacturing apparatus.

When the restriction and the cutting of the thread bundle 20 are finished, the clamper unit 70 moves between the first welding horn 80 and the second welding horn 90 while the clamper 73 restricts the thread bundle 20, as shown in FIG. 8(*a*), and the thread bundle 20 is conveyed during the while. Then, as shown in FIG. 8(*b*), the first welding horn 80 starts moving up from the downward evacuated position while supersonic vibrating, and opens the thread materials 21 of the thread bundle 20 protruding to the below of the clamper 73 to the periphery. Further, when the first welding horn 80 goes on moving upward, the thread materials 21 further open to the periphery, and the thread materials 21 opening to the periphery are finally pressed to the periphery of the chuck hole in the lower surface of the clamper 73 by the weld surface 81 of the first welding horn 80, as shown in FIG. 8(*c*).

The thread materials 21 in the downward protruding part of the thread bundle 20 is completely opened to the periphery and formed into a radial shape, by the pressing by the weld surface 81 of the first welding horn 80. At the same time, since the first welding horn 80 supersonic vibrates, the vicinity of the center part of the radial thread materials 21 which are pressed by the weld surface 81 of the first welding horn 80 is annularly welded, and forms an annular weld part 22*a* (refer to FIG. 8(*d*)).

At this time, the rod-like convex part 82 provided in the center part of the upper end surface of the first welding horn 80 is inserted to the center part of the thread bundle 20 in the final stage of the opening process of the thread bundle 20 and before the welding starts, and is welded in a state in which a circular space is secured in the center part of the thread bundle 20 by passing through the center part of the thread bundle 20. Since the rod-like convex part 82 is formed as the separate member which is independent from the first welding horn 80 so as to be inhibited resonance with the first welding horn 80, the rod-like convex part 82 prevents the welding of the part which is in contact with the space of the thread materials 21 radially opening to the periphery. Further, the annular recessed part 83 inhibits the inner edge part of the thread materials 21 radially opening to the periphery (the vicinity of the space) from being welded, and contributes to the formation of the annular fold-over part 12. As mentioned above, the formation of the first radial vane 10*a* is finished.

When the welding by the first welding head 83 is finished, and the formation of the first radial vane 10*a* is finished, the clamper 73 opens as shown in FIG. 8 (*d*). Then, as shown in FIG. 8(*e*) the second welding horn 90 starts moving down from the upward evacuated position. As a result, the thread materials 21 existing in the periphery of the rod-like convex part 82 doubling as the guide pin of the first welding horn 80 opens to the periphery. Further, the rod-like convex part 82 of the first welding horn 80 is inserted to the circular recessed part 92 which is the clearance part of the second welding horn 90. When the second welding horn 90 goes on further moving downward, the thread materials 21 open radially and are pressed to the weld surface 81 of the first welding horn 80 by the weld surface 91 of the second welding horn 90, as shown in FIG. 8(*f*).

As a result, an annular weld part 22*b* (refer to FIG. 8(*g*)) is formed in the second radial vane 10*b*. The annular weld surface 81 of the first welding horn 80 doubles as a processing pedestal in a lower side. At this time, since the rod-like convex part 82 of the first welding horn 80 which is inserted to the circular recessed part 92 corresponding to the clearance part of the second welding horn 90 is a separate member which is independent form the second welding horn 90, the rod-like convex part 82 inhibits the inner surface of the thread materials 21 opening radially to the periphery from being welded. The annular recessed part 93 formed in the periphery of the circular recessed part 92 of the second welding horn 90 inhibits the inner edge part (the vicinity of the space) of the thread materials 21 opening radially to the periphery from being welded, and contributes to formation of the annular fold-over part 12 in the side of the second radial vane 10*b*. Further, the annular recessed part 93 formed in the periphery of the rod-like convex part 82 of the first welding horn 80 inhibits deformation of the annular fold-over part 12 which is formed in the side of the first radial vane 10*a*.

Accordingly, the radial vane 10 of two-ply structure integrated by the annular weld parts 22*a* and 22*b* is formed at the same position, that is, between the first welding horn 80 and the second welding horn 90. The integrated annular weld parts 22*a* and 22*b* form the annular core part 13 of the completed radial vane 10, and the annular fold-over part 12 is formed in an inner side of the annular core part 13.

When the radial vane 10 is formed between the first welding horn 80 and the second welding horn 90, the first welding horn 80 returns to the downward evacuated position, and the second welding horn 90 returns to the upward evacuated position, as shown in FIG. 8(*g*).

The manufacturing method has an advantage that the apparatus cost can be reduced, in a point that the clamper 73 and the second welding horn 90 double as the processing pedestal, and any exclusive processing pedestal is not necessary, and a point that the rod-like convex part 82 of the first welding horn 80 doubles as the guide pin and any exclusive guide pin is not necessary.

Figure 9:
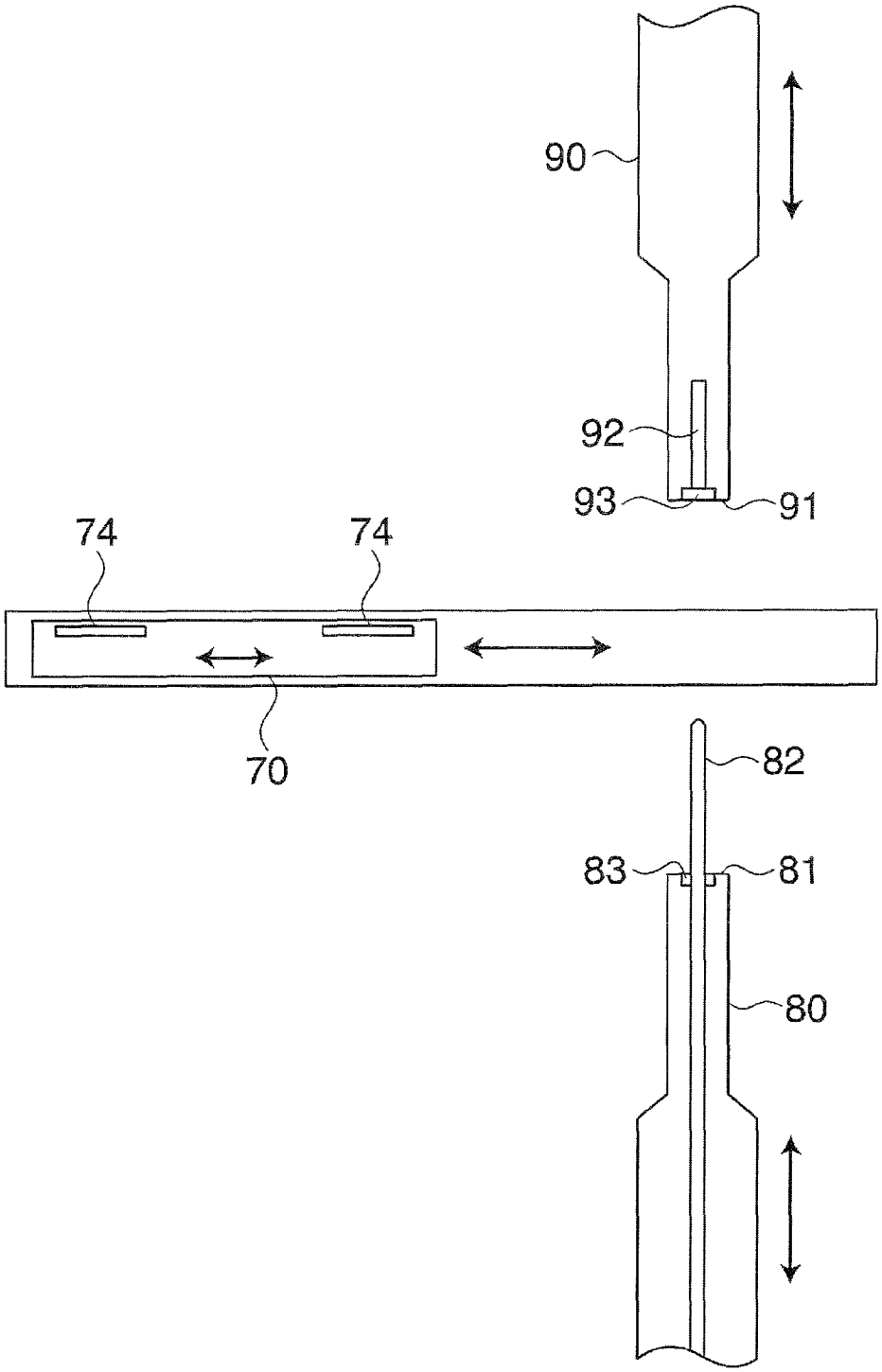
FIG. 9 shows the other example of the method of manufacturing the radial vane according to the present invention, and is a structural view of a manufacturing apparatus which is suitable for manufacturing the radial vane.

A manufacturing apparatus shown in FIG. 9 is basically the same as the manufacturing apparatus shown in FIG. 7 in the apparatus structure. The manufacturing apparatus in FIG. 9 is mainly different in a point that a clamper 74 within a clamper unit 70 does not double as the processing pedestal in the same manner as the manufacturing apparatus shown in FIG. 4, a point that alternatively the clamper 74 doubles as a side welding unit, and a point that a weld surface 91 of a second welding horn 90 doubles as the processing pedestal together with a weld surface 81 of a first welding horn 80.

Figure 10:
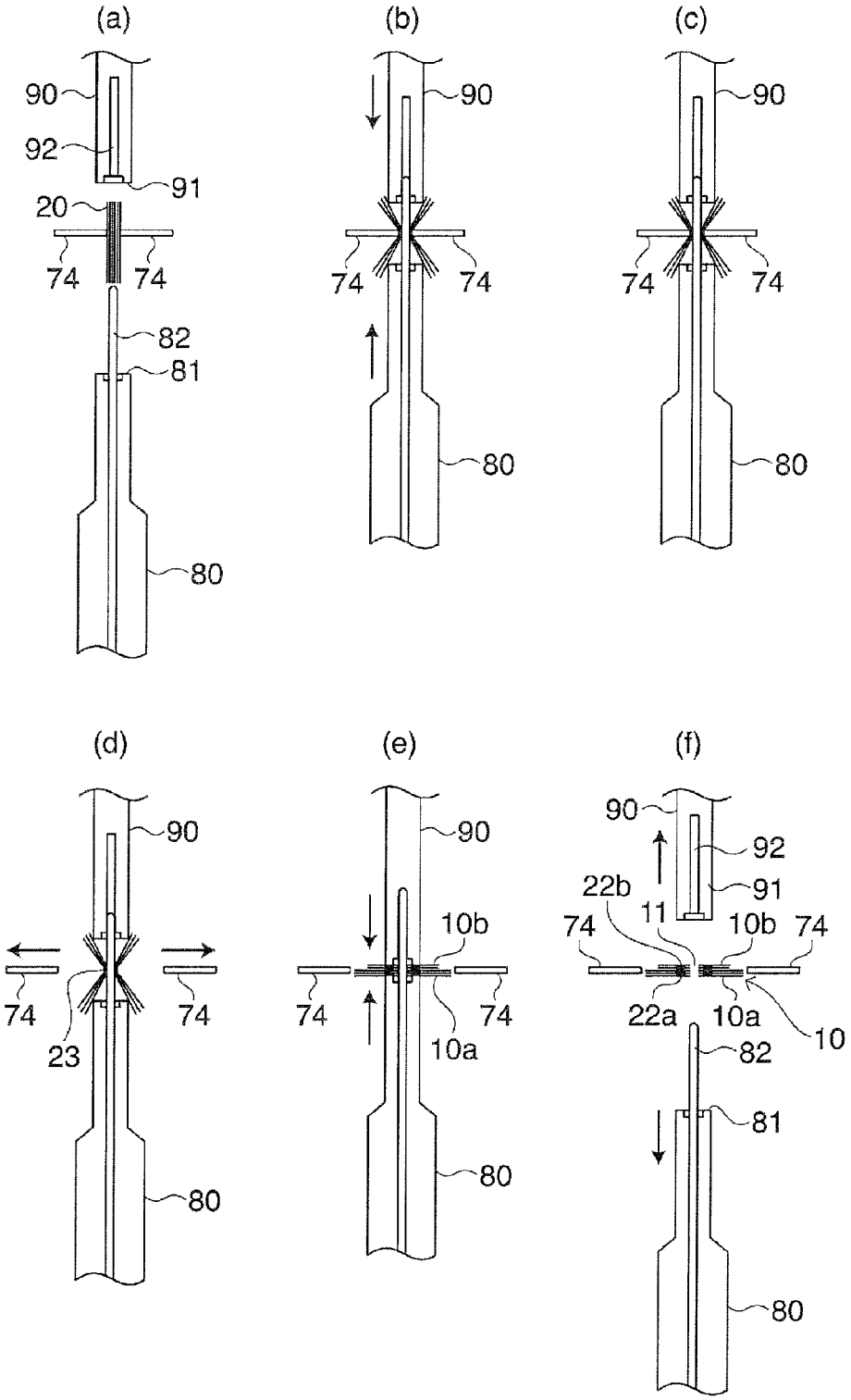
FIGS. 10(*a*) to 10(*f*) are views explaining steps of the manufacturing method using the manufacturing apparatus.
Figure 11:
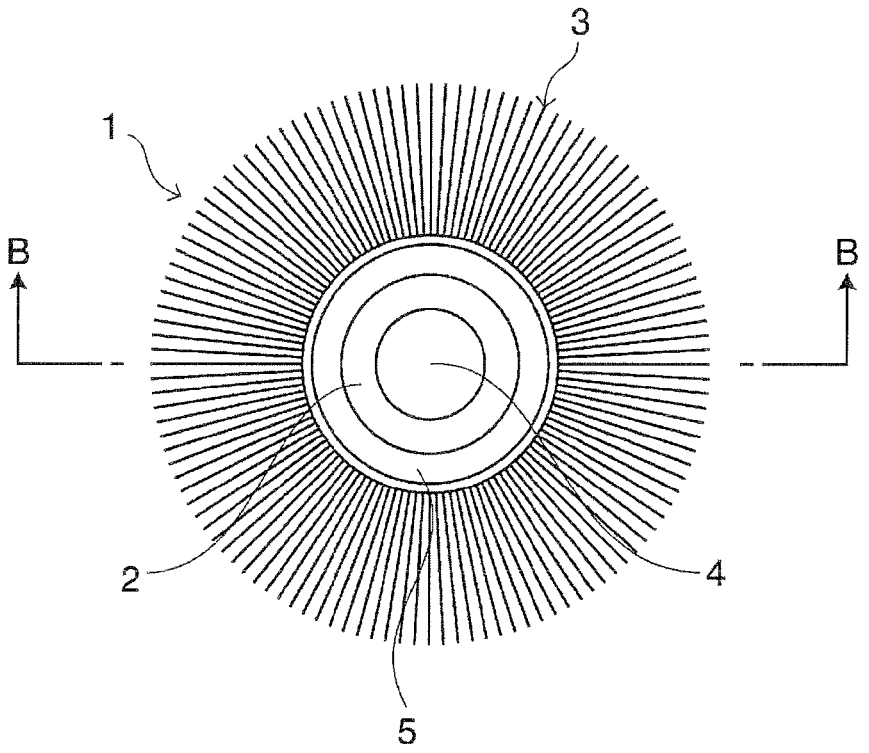
FIG. 11(*a*) is a plan view showing a structure of a conventional radial vane and FIG. 11(*b*) is a cross sectional view taken along a line B-B.
Figure 11:
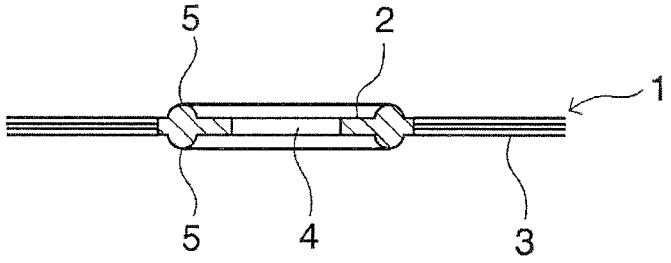
Figure 12:
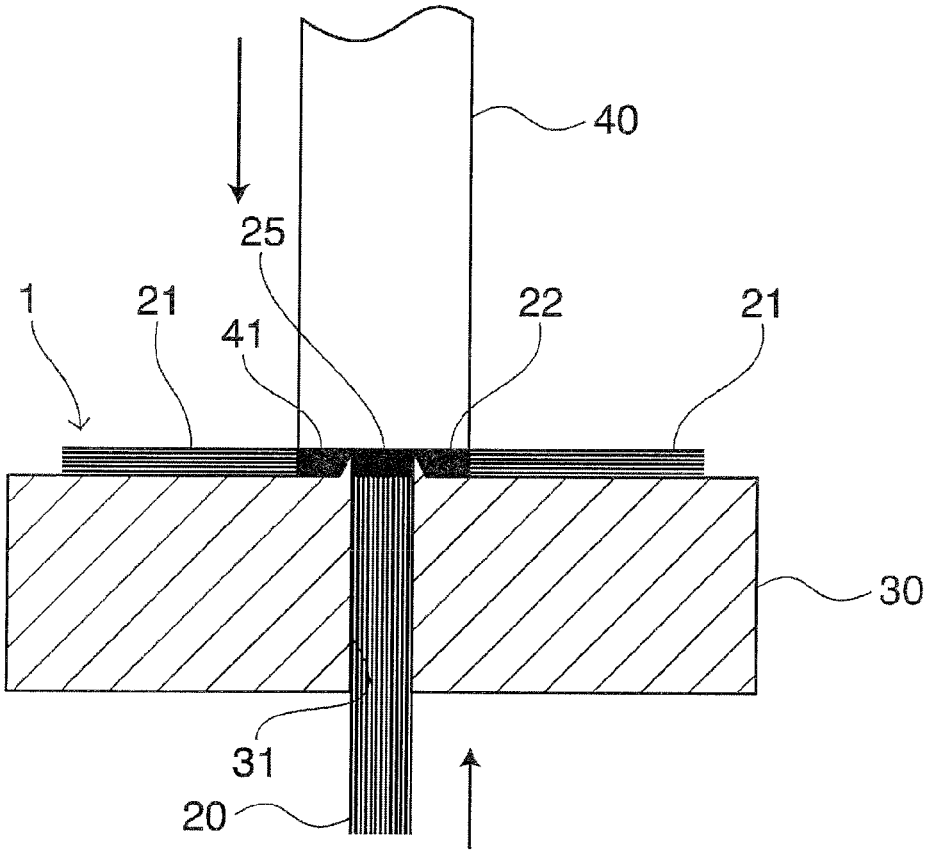
FIG. 12 is a view explaining a method of manufacturing the conventional radial vane.

Further, the manufacturing apparatus in FIG. 9 is different in timing in a point that the first welding horn 80 arranged below a clamper conveyance unit 71 and the second welding horn 90 arranged above the clamper conveyance unit 71 simultaneously move up and down as shown in FIGS. 10(*a*) to 10(*f*).

More specifically, in the manufacturing apparatus shown in FIG. 9, first of all, the clamper unit 70 is positioned in a left part of the clamper conveyance unit 71, and the thread bundle 20 discharged out of a thread feeding unit which is arranged above the clamper unit 70 and is not shown is restricted by a clamper 72 within the clamper unit 70. Next, the thread bundle 20 is cut by a cutter unit which is provided below the thread feeding unit and is not shown. A cut length (a discharge length) of the thread bundle 20 is a length which is necessary for manufacturing the radial vane 10 of double structure. More specifically, a length of the thread bundle below the center of a clamp position by a clamper 74 is an amount which is necessary for the first radial vane 10*a*, and a length of the thread bundle above the center of the clamp position by the clamper 74 is an amount which is necessary for the second radial vane 10*b*.

When the restriction and the cutting of the thread bundle 20 are finished, the clamper unit 70 moves between the first welding horn 80 and the second welding horn 90 while the clamper 74 restricts the thread bundle 20, as shown in FIG. 10(*a*), and the thread bundle 20 is conveyed during the while. Then, as shown in FIG. 10(*b*), the first welding horn 80 starts moving up from the downward evacuated position while supersonic vibrating, and the second welding horn 90 simultaneously starts moving down from the upward evacuated position while supersonic vibrating. As a result, the thread bundles 20 protruding to the up and down of the clamper 74 simultaneously open to the periphery.

When the first welding horn 80 and the second welding horn 90 go on moving up and moving down further, the restricted part of the thread bundle 20 is temporarily welded by the clamper 74 which doubles as the side welding unit, as shown in FIG. 10(*c*). Thereafter, as shown in FIG. 10(*d*), the clamper 74 evacuates to both sides, and the first welding horn 80 and the second welding horn 90 further go on moving up and moving down. Finally, as shown in FIG. 10(*e*), the parts below and above the temporary weld part 23 (refer to FIG. 10(*d*)) of the thread bundle 20 open radially to the periphery, and the periphery of the center part is welded between the weld surface 81 of the first welding horn 80 and the weld surface 91 of the second welding horn 90.

During the welding, the center part of the thread bundle 20 opening to the periphery forms a through hole by inserting a rod-like convex part 82 of the first welding horn 80 thereto.

Accordingly, the radial vane 10 of double structure (two-ply structure) is manufactured. An advantage of the manufacturing method exists in a point that a manufacturing speed is high since the lower radial vane 10*a* and the upper radial vane 10*b* are simultaneously formed. Since the rod-like convex part 83 of the first welding horn 80 is a separate member which is independent from the first welding horn 80 and the second welding horn 90, the inner peripheral surface of the annular fold-over part 12 is inhibited from being welded, and the annular recessed part 83 of the first welding horn 80 and the annular recessed part 93 of the second welding horn 90 contribute to the formation of the annular fold-over part 12, in the same manner as the case of the manufacturing method by the manufacturing apparatus shown in FIG. 7.

In any manufacturing method, it is possible to adjust the outer diameter of the radial vane 10 and the respective outer diameters of the radial vanes 10*a* and 10*b* constructing the radial vane 10 in a wire range, by changing the cutting amount (the discharge amount) of the thread bundle 20 and the clamp position of the thread bundle 20 by the clampers 72, 73 and 74.

Figure 2:
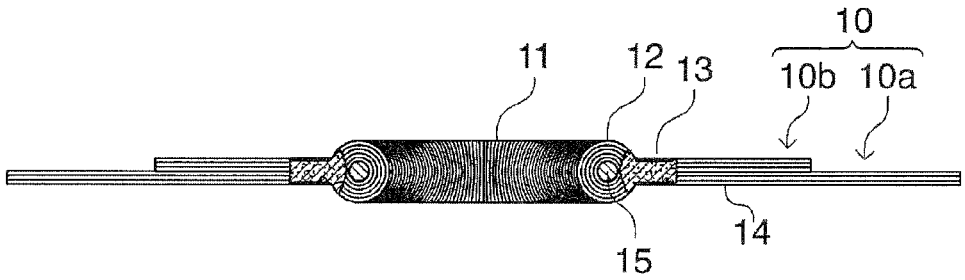
FIG. 2 is a vertical cross sectional view showing a structure of the other example of the radial vane according to the present invention, and corresponds to a cross sectional view as seen from the arrow A-A in FIG. 1(*a*).

The radial vane shown in FIG. 2 is structured such that a ring-like reinforcing member 15 is inserted into the annular fold-over part 12. Since the annular fold-over part 12 is formed by curving the thread bundle 20 to an outer side in a state in which a space is formed in the center part, the ring-like reinforcing member 15 may be inserted at the curving time. Further, a mechanical strength in a peripheral direction of the annular weld part is further improved by inserting the ring-like reinforcing member 15 into the annular fold-over part 12.

Figure 3:
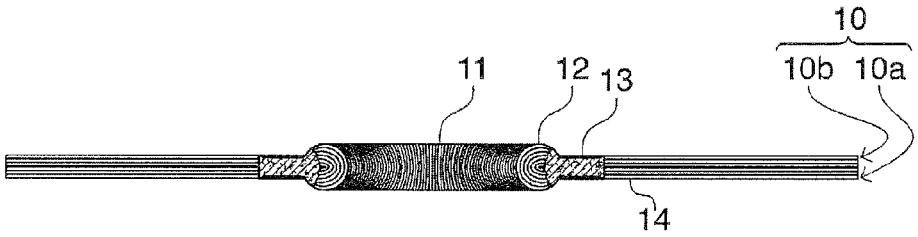
FIG. 3 is a vertical cross sectional view showing a structure of further the other example of the radial vane according to the present invention, and corresponds to a cross sectional view as seen from the arrow A-A in FIG. 1(*a*).

In the radial vane shown in FIG. 3, the first radial vane 10*a* and the second radial vane 10*b* in the radial vane 10 of double structure have the same size, and respective thread lengths in the vane parts 14 are identical. The radial vanes 10 having the various sizes and shapes can be manufactured by selecting the length of the thread bundle 20 used for manufacturing and selecting the position of the annular fold-over part 12, as mentioned above.

In the case that the annular fold-over part 12 is not formed in the periphery of the through hole 11 of the radial vane 10, that is, in the case that the welding is applied to the inner peripheral edge of the fold-over part of the thread materials 21 in the spatial periphery, it goes without saying that it is not necessary to make the rod-like convex parts 53*b* and 83 in the first welding units 50 and 80 independent from the first welding units 50 and 80, and it is not necessary to set the annular recessed parts 53*c* and 83 as the clearance part.

DESCRIPTION OF REFERENCE SIGNS

10, 10*a*, 10*b*: radial vane
11: through hole
12: annular fold-over part
13: annular core part
14: vane parts
15: reinforcing member
20: thread bundle
21: thread materials
22: annular weld part
23: temporary weld part
50: first welding unit
51: thread feeding unit
52: first processing pedestal
53: first welding horn
53*a*: weld surface
53*b*: rod-like convex part (rod-like object)
53*c*: annular recessed part
60: second welding unit
61: second welding horn
61*a*: weld surface
61*b*: circular recessed part
61*c*: annular recessed part
62: second processing pedestal
63: guide pin
70: clamper unit
71: clamper conveyance unit
72, 73, 74: clamper
80: first welding horn
81: weld surface
82: rod-like convex part (rod-like object)
83: annular recessed part
90: second welding horn
91: weld surface
92: circular recessed part
93: annular recessed part
100: cutter unit

The invention claimed is:

1. A radial vane in a disk-shape comprising:

radial vane parts which are formed by extending a plurality of thread materials to an outer peripheral side from a hole region in a peripheral direction of a disk-shaped annular core part having a through hole in a center part, wherein a longitudinal intermediate part of one continuous thread bundle is formed as an annular fold-over pan, thread bundles in end sides of the fold-over pan are radially opened and superposed while leaving a space in the center part, and a spatial periphery of the center part is annularly welded so as to form the core part, and wherein an outer side of the annular fold-over part formed in the spatial periphery of the center part is annularly welded so as to form the core part.

2. The radial vane according to claim 1, wherein the annular fold-over part comprises a boss part which protrudes like a dome to opposite surface sides of the radial vane, protrudes like an arch to an inner surface side of the radial vane, is thicker than the annularly welded part of the annular fold-over part and has greater elasticity than the annularly welded part of the annular fold-over part.

3. A method of manufacturing a radial vane in a disk-shape including radial vane parts which are formed by extending a plurality of thread materials to an outer peripheral side from a hole region in a peripheral direction of a disk-shaped annular core part having a through hole in a center part, the method comprising:

a first opening step of setting a longitudinal intermediate part of one continuous thread bundle to an annular fold-over part, and radially opening a thread bundle in a first end side of the annular told-over part to the periphery in a state in which the annular fold-over part is set to a starting point and a space is secured in the center part;

a first welding step of annularly welding the thread bundle in the first end side radially opened to the periphery in a spatial periphery of the center part;

a second opening step of radially opening the thread bundle in a second end side of the annular fold-over part to the periphery in a state in which the fold-over part is set to a starting point and a space is secured in the center part; and a second welding step of annularly welding the thread bundle in the second end side radially opened to the periphery in the spatial periphery of the center part.

4. The method of manufacturing a radial vane according to claim 3, wherein the thread bundles in the first and second end sides opening radially to the periphery are welded annularly in an outer side of the annular fold-over part formed in the spatial periphery of the center part, in the first welding step and the second welding step.

5. The method of manufacturing a radial vane according to claim 4, wherein the first opening step, the first welding step, the second opening step and the second welding step are executed step by step.

6. The method of manufacturing a radial vane according to claim 4, wherein the first opening step and the second opening step are simultaneously executed, and the first welding step and the second welding step are simultaneously executed continuously.

7. The method of manufacturing a radial vane according to claim 3, wherein the first opening step, the first welding step, the second opening step and the second welding step are executed step by step.

8. The method of manufacturing a radial vane according to claim 3, wherein the first opening step and the second opening step are simultaneously executed, and the first welding step and the second welding step are simultaneously executed continuously.

* * * * *